United States Patent [19]

Warnan

[11] Patent Number: 4,954,110

[45] Date of Patent: Sep. 4, 1990

[54] UNDERWATER BUOY PROVIDED WITH HYDRODYNAMIC STABILIZING MEANS AND DESIGNED TO BE SUSPENDED, NOTABLY FROM A HELICOPTER

[75] Inventor: Francois Warnan, Trappes, France

[73] Assignee: Thomson-CSF, Puteaux, France

[21] Appl. No.: 336,058

[22] Filed: Apr. 11, 1989

[30] Foreign Application Priority Data

Apr. 12, 1988 [FR] France ..... 88 04829

[51] Int. Cl.[5] ..... B63B 22/18

[52] U.S. Cl. ..... 441/22; 114/244; 114/245; 114/332; 244/1 TD

[58] Field of Search ..... 441/22; 114/244, 332, 114/245; 244/1 TD, 3

[56] References Cited

U.S. PATENT DOCUMENTS

| | | | |
|---|---|---|---|
| 3,159,806 | 12/1964 | Piasecki | 114/245 |
| 3,296,996 | 1/1967 | Miller | 114/244 |
| 3,327,968 | 6/1967 | Converse | 244/1 TD |
| 3,380,424 | 4/1968 | Bowker et al. | 114/245 |
| 3,500,209 | 3/1970 | Fletcher et al. | 441/22 |
| 3,618,555 | 11/1971 | Kelly et al. | 114/244 |
| 3,672,322 | 6/1972 | Van Der Linde | 114/245 |
| 3,755,836 | 9/1973 | Milazzo | 441/22 |
| 3,793,623 | 2/1974 | Gongwer | 114/244 |
| 4,528,930 | 7/1985 | Silvey et al. | 114/244 |

FOREIGN PATENT DOCUMENTS

| | | |
|---|---|---|
| 24988 | 3/1981 | European Pat. Off. . |
| 2438588 | 5/1980 | France . |

*Primary Examiner*—Sherman D. Basinger
*Assistant Examiner*—Thomas J. Brahan
*Attorney, Agent, or Firm*—Oblon, Spivak, McClelland, Maier & Neustadt

[57] ABSTRACT

In a sonar buoy suspended from a helicopter, the lower stabilizing ring of a buoy of this type is replaced by a set of fins which get folded against the body of the buoy during its descent into the water and get unfolded when they are raised again to form a stabilizing crown around the bottom of this body, thus enabling a buoy of this type to be stabilized both during descent and when being raised again.

3 Claims, 2 Drawing Sheets

UNDERWATER BUOY PROVIDED WITH HYDRODYNAMIC STABILIZING MEANS AND DESIGNED TO BE SUSPENDED, NOTABLY FROM A HELICOPTER

BACKGROUND OF THE INVENTION

1. Field of the Invention

The present invention relates to underwater buoys designed to be submerged and held inside the water at the end of a cable which is itself hooked to a carrier vehicle such as a helicopter. These buoys can be used inter alia for the detection of submerged objects, notably submarines, either by passive listening or by means of a sonar.

2. Description of the Prior Art

Since submarines are able to descend to increasingly great depths, it is necessary, in order to detect them with certainty, to take detection buoys down to depths of the same order, namely depths of several hundreds of meters. This, of course, makes it necessary to unwind and wind the carrier cable along the same length, while preventing oscillations which are harmful as much through variations in tension given to the cable as through the risk of the coils getting jumbled on the drum of the winch on which this cable is wound.

These oscillations are due to the slowing down of the buoy when it goes askew or even sideways under the effect of phenomena of hydrodynamic instability due to the relative motion of the water with respect to the buoy. To remove this instability and keep the buoy vertical while it descends or rises, there are known ways, as shown in FIG. 1, to provide the body 10 of this buoy, suspended to the end of the cable 11, with an upper ring 12 and a lower ring 13 which surround the ends of this body in setting up, between the body and themselves, a space designed to let through the streams of water while the buoy moves. Furthermore, the buoy has a ballast 14 placed at its lower end.

The effect of these rings differs according to whether the buoy is plunging or rising up again. The top ring 12 is efficient in stabilizing the buoy in descent but, on the contrary, during the rising stage, it tends to behave like a fin which causes a swirling motion as shown in FIG. 2.

The bottom ring makes it possible, in principle, to overcome this drawback by countering this swirling motion since it is placed beneath the center of gravity of the buoy. However, during descent, this bottom ring 13 also behaves like a fin and itself tends to generate a swirling motion. This motion is not exactly the same as that generated, during the rising stage, by the ring 12, because the action of the ballast 14 is not identical to the traction of the cable 11 but, in all, the effects of the two rings impede each other and the overall result is hardly efficient.

SUMMARY OF THE INVENTION

To overcome these drawbacks, the invention proposes to replace the bottom stabilizing ring by a set of fins which can be folded during descent and which, therefore, have no effect during this stage, and can be deployed, during the rising stage, to stabilize the buoy.

BRIEF DESCRIPTION OF THE DRAWINGS

Other features and advantages of the invention will appear more clearly from the following description, made with reference to the appended figures, of which.

DESCRIPTION OF PREFERRED EMBODIMENTS

Figure 1:
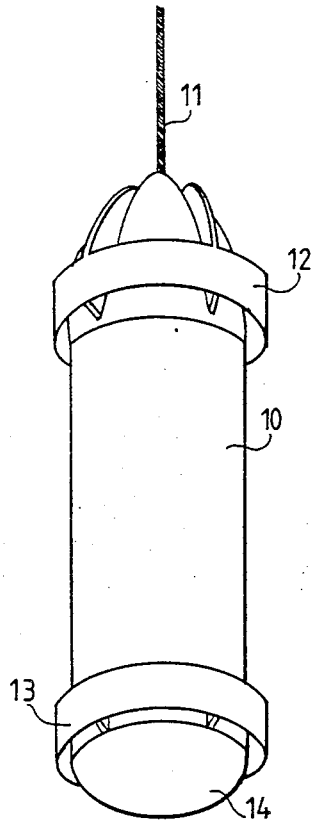
FIG. 1 PRIOR ART
FIG. 1 shows a view of the buoy according to the prior art.
Figure 2:
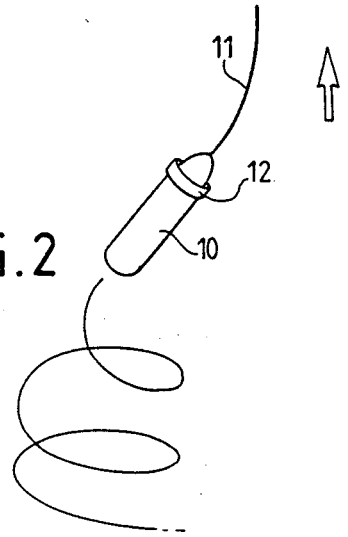
FIG. 2 is a depiction of the motion of a prior art buoy having only one upper stabilizing ring.
Figure 3:
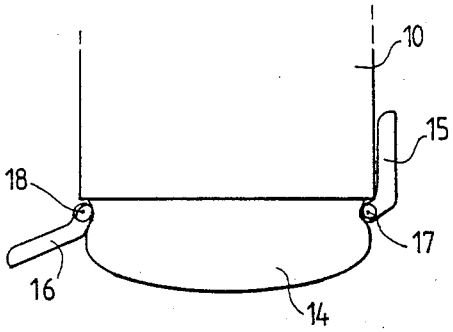
FIG. 3 is a drawing showing a bottom view of a buoy having foldable fins according to the invention.

FIG. 3 shows a view of the lower part of a buoy according to the invention. In order to make it easier to read the drawing, this buoy is given only two fins 15 and 16.

The ballast 14 is, for example, machined so that its circumference is substantially recessed with respect to the cylindrical body 10 of the buoy. This cylindrical part is provided with lugs 17 and 18 which project outwards from the ballast and are provided with pins to which fins 15 and 16 get fixed by one end. These fins can thus rotate on these pins which are located in a plane perpendicular to the axis of the buoy and are tangential to the circumference of the ballast.

Thus, during descent, the fins pivot on the pins to get folded against the body of the buoy like the fin 15 in the figure. During the rising stage, these fins get unfolded so as to project outwards from this body and radially with respect to it, like the fin 16 in the figure. Of course, all the fins are simultaneously unfolded or folded, and the contrary positions of the fins 15 and 16 in FIG. 3 are used purely for purposes of explanation.

In order to prevent whirlpools which might possibly interfere with the stability of the buoy during descent, the contour of these fins is advantageously that of a fin with the driving edge pointed downwards. In other words, the fins extend substantially vertically and have a leading edge which is pointed towards the bottom of the buoy. During the rising stage, this fin works in reverse, but the appearance, if any, of whirlpools at this time creates no serious drawbacks.

Since the fins are mounted so as to be free on their axis of rotation, it is clear that they will tend to remain unfolded when the buoy rises up again towards the helicopter, from which it is suspended, to re-enter the funnel-shaped receiving part (called a funnel) located beneath the helicopter. To prevent the ends of the fins from getting caught against the wall of this funnel in the final stage of the rising stage, the dimensions of the fins are chosen so that, when unfolded, their free ends do not go beyond the diameter determined by the upper ring 12.

Figure 4:
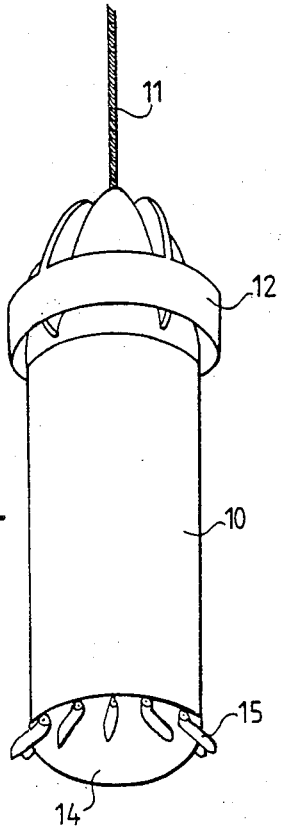
FIG. 4 shows a general view of a buoy having these very same fins.

FIG. 4 shows a full view of a buoy according to the invention, having a set of fins 15, seen in unfolded position and forming a crown all around the ballast 14 on the lower part of the body 10 of the buoy.

In a particular exemplary embodiment, twelve fins were used. They were 80 mm. long and 15 mm. wide, with a thickness at the center equal to 3 mm.

For a descending speed equal to 6 m/s, the hydrodynamic force on each fin is substantially equal to 1 N: this is amply sufficient to obtain a rotation of the fin on the axis and to keep it in the folded position along the body of the buoy.

Under these conditions, efficient stabilization of the buoy is observed during descent, and no particular tendency towards rotation during the rising stage.

It is clear that the fixing of the fins by means of lugs and pins, as described above, concerns only one particular embodiment of the invention, and that any other embodiment enabling the folding and unfolding of the fins, for example, using slots made in the ballast, or bosses provided on this ballast during the machining operation, come within the scope of the invention.

What is claimed is:

1. An underwater buoy, provided with hydrodynamic stabilization means and designed to be suspended from a carrier vehicle by a cable, said buoy comprising a body, said body having a ring placed on the upper part of the body, fins placed on the lower part of the body, which get folded during the descent into the water so as to then have a substantially null effect, and get unfolded during the rising stage to stabilize the motion of the buoy by preventing the buoy from being made to rotate, wherein the fins extend substantially vertically and have a leading edge of which is pointed towards the bottom of the buoy, said buoy further comprising a ballast placed in the lower part of the body, said ballast being machined so that it is recessed from the circumference of the body, and being provided with joint features, located on its circumference, to hold fins.

2. A buoy according to claim 1, wherein the joint features are formed by lugs fixed to the ballast and pins fixed to these lugs, the pins being located in a plane perpendicular to the axis of the buoy.

3. A buoy according to claim 1, wherein the joint features are formed by slots hollowed out in the ballast and pins fixed to these slots, the pins being located in a plane perpendicular to the axis of the buoy.

* * * * *